US008602493B1

(12) United States Patent
Chen et al.

(10) Patent No.: US 8,602,493 B1
(45) Date of Patent: Dec. 10, 2013

(54) CHAIR WITH A HIP-SHAPING SEAT

(75) Inventors: Chiung-Kuang Chen, Taichung (TW); Chun-Yen Hsieh, Taichung (TW); David Guy Valdiserri, Taichung (TW)

(73) Assignee: Yung-Kun Chen, Hsinchu County (TW)

( * ) Notice: Subject to any disclaimer, the term of this patent is extended or adjusted under 35 U.S.C. 154(b) by 0 days.

(21) Appl. No.: 13/540,599

(22) Filed: Jul. 2, 2012

(51) Int. Cl.
*A47C 7/14* (2006.01)

(52) U.S. Cl.
USPC ..... 297/284.9; 297/452.23

(58) Field of Classification Search
USPC ..... 297/254.9, 201, 452.23
See application file for complete search history.

(56) References Cited

U.S. PATENT DOCUMENTS

| | | | | | |
|---|---|---|---|---|---|
| 629,956 | A * | 8/1899 | Craig | ..... | 297/201 |
| 2,619,157 | A * | 11/1952 | Guyton et al. | ..... | 297/284.9 |
| 5,580,128 | A * | 12/1996 | Johnson et al. | ..... | 297/314 |
| 6,290,291 | B1 * | 9/2001 | Kojima | ..... | 297/201 |

* cited by examiner

*Primary Examiner* — Sarah B McPartlin

(57) ABSTRACT

A chair with a hip-shaping seat is provided with a base, a seat and two elastic members. The seat is formed by two seat members, and on the top of each of the seat members is formed an arc-shaped surface. The two seat members are pivoted connected at one end, and are capable of opening and closing at another end, so that the width of the seat space can also be adjusted to fit different sized hips, through pivoting of the seat members. Hence, the chair of the present invention is capable of effectively holding the hip and preventing the hip from sagging.

7 Claims, 10 Drawing Sheets

CHAIR WITH A HIP-SHAPING SEAT

BACKGROUND OF THE INVENTION

1. Field of the Invention

The present invention relates to a chair, and more particularly to a chair with a hip-shaping seat.

2. Description of the Prior Art

FIG. 1 shows a conventional chair 10 which comprises a base 11, a plurality of rollers 111 at the bottom of the base 11, and a seat 12 on the base 11. The seat 12 includes a back 121 and two armrests 122 at both sides of the back 121.

When a user sits on the seat 12, his/her hip will be pressed against the seat 12, resulting in an expansion of the flesh in the hip toward both sides of the body. To make the user feel comfortable and relaxed when sitting on the chair 10, the seat 12 is normally made of a hard base and a soft cushion disposed on the hard base, and the top of the seat 12 is in the shape of an arc-shaped convex or concave. It is to be noted that sitting on such a seat 12 for a long time will make the hip look flat and fat, especially for the women whose hips are more likely to get fat than men, and women's floppy and strengthless hip muscles would make the problem of the hip being out shape more noticeable.

Hence, a hip-shaping cushion has been designed to solve the abovementioned problem, and the hip-shaping cushion is put on the seat 12 to hold the hip. However, the size of the hip-shaping cushion is fixed, and the hip-shaping ability of the cushion when comfort should also be taken into account. Furthermore, putting a cushion on the seat 12 will increase the sitting height of the user, which is likely to lead to spinal cord injury.

The present invention has arisen to mitigate and/or obviate the afore-described disadvantages.

SUMMARY OF THE INVENTION

The primary object of the present invention is to provide a chair with a hip-shaping seat, the seat is formed by two seat members, and on the top of each of the seat members is formed an arc-shaped surface. The two seat members are pivoted connected at one end, and are capable of opening and closing at another end, so that the width of the seat space can also be adjusted to fit different sized hips, through pivoting of the seat members. Hence, the chair of the present invention is capable of effectively holding the hip and preventing the hip from sagging.

To achieve the above object, the chair with a hip-shaping seat in accordance with the present invention comprises: a base, a chassis, a seat, two elastic members, an adjustment rod and a chair back. The base includes an assembling portion. The chassis includes a front end and a rear end, and a direction extending from the front end to the rear end is defined as X. Between the front end and the rear end are connected a bottom surface and a top surface. The bottom surface is formed with an assembling portion assembled to the assembling portion of the base, and an inserting portion formed at the rear end of the chassis. On the top surface of the chassis is provided a pivot located at the front end and an arc-shaped rail located adjacent to the rear end, and the pivot is a section of a circle whose center is located at the position of the pivot, on the guiding rail being provided two slide blocks. The seat is formed by two symmetrical seat members, on top of each of the seat members is formed an arc-shaped surface which has a lateral edge, so that, when the two seat members are assembled together along the lateral edges, the two arc-shaped surfaces cooperate with each other to define a seat space. Each of the seat members is provided with an ear portion adjacent to one end of the lateral edge for insertion of the pivot of the chassis, and a pivot portion adjacent to another end of the lateral edge, each of the seat members is further formed on a bottom thereof with an assembling portion 46 which is located adjacent to the lateral edge for assembling the slide blocks of the chassis. The adjustment rod includes a rod portion and two positioning rings, the rod portion is formed with a clockwise thread, a counterclockwise thread, and a positioning section between the clockwise thread and the counterclockwise thread. Each of the positioning rings is formed with a pivot to be pivotally connected to the pivot portion of the seat members and a threaded hole for insertion of the rod portion, in such a manner that the threaded hole of one of the positioning rings is screwed with the clockwise thread, and the threaded hole of another one of the positioning rings is screwed with the counterclockwise thread.

The chair back includes a back portion and a fixing portion extending from a bottom of the back portion. In the middle of the fixing portion is formed a positioning slot extending in the direction X, the fixing portion is inserted in the inserting portion of the chassis, and the positioning section of the rod portion of the adjustment rod is restricted in the positioning slot.

DETAILED DESCRIPTION OF THE PREFERRED EMBODIMENTS

Figure 1:
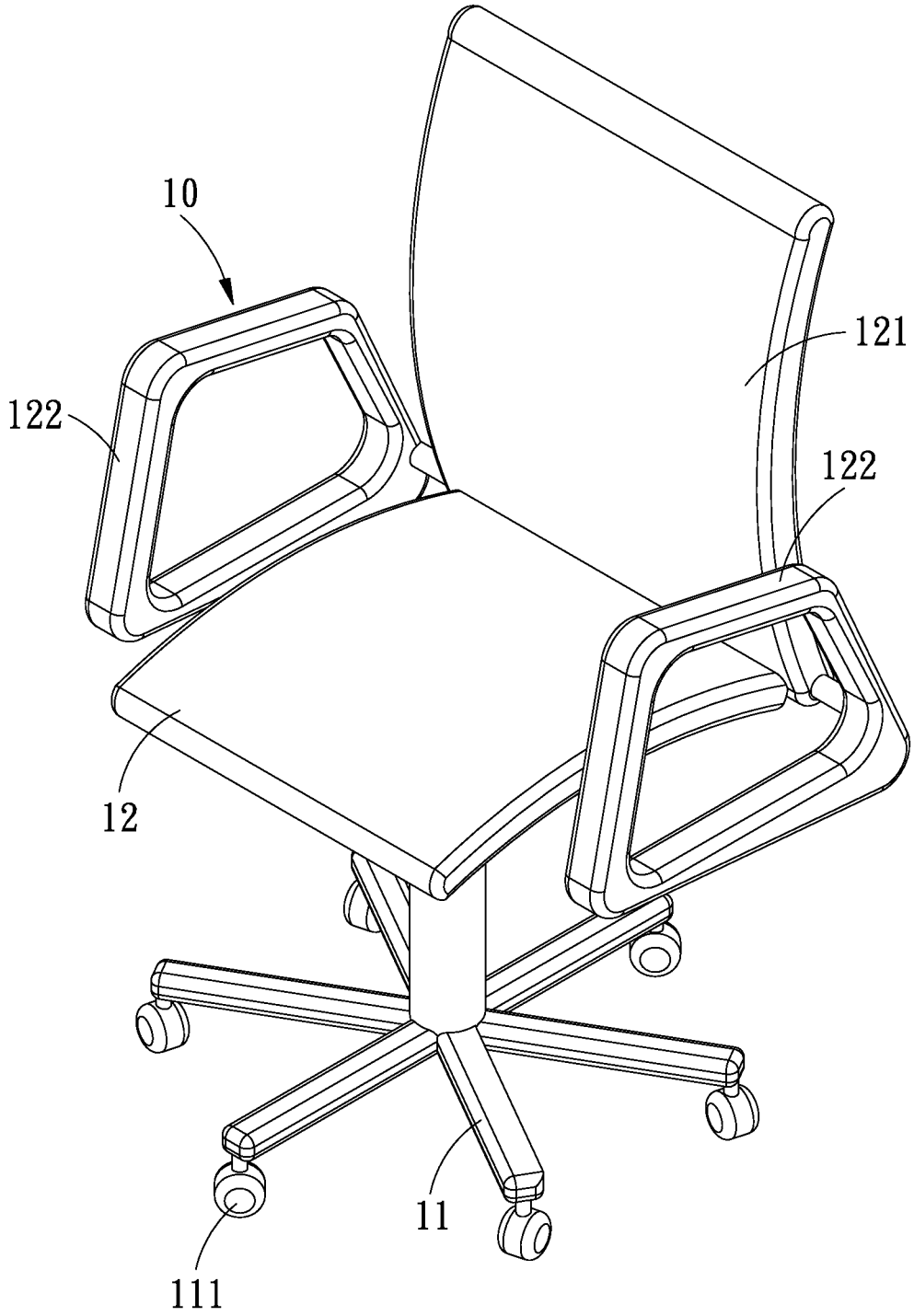
FIG. 1 PRIOR ART
FIG. 1 is a perspective view of a conventional chair.
Figure 2:
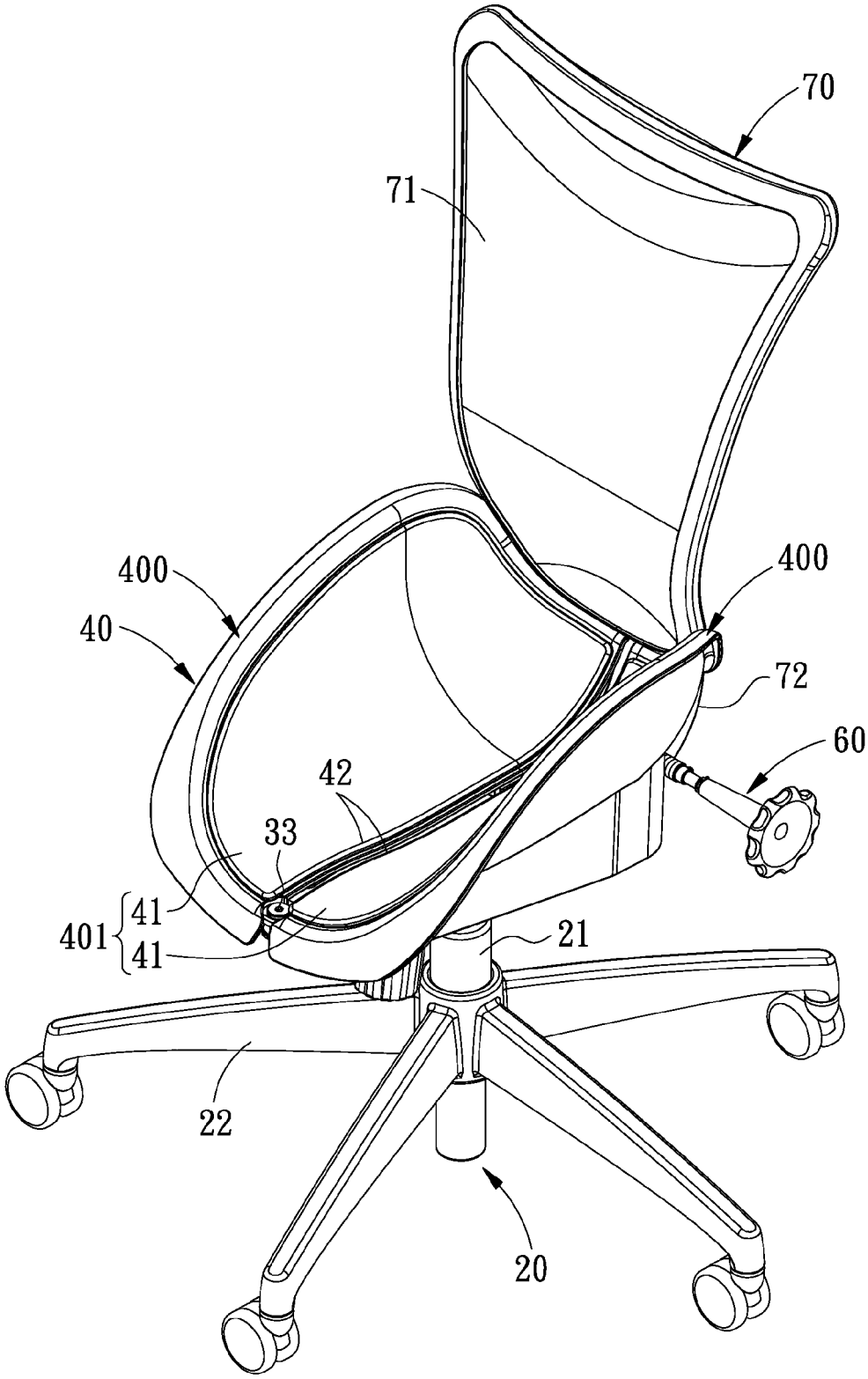
FIG. 2 is a perspective view of a chair with a hip-shaping seat in accordance with the present invention.

The present invention will be clearer from the following description when viewed together with the accompanying drawings, which show, for purpose of illustrations only, the preferred embodiment in accordance with the present invention.

Referring to FIGS. 2-4, 5, 7 and 9, a chair with a hip-shaping seat in accordance with the present invention comprises a base 20, a chassis 30, a seat 40, two elastic members 50, an adjustment rod 60 and a chair back 70.

Figure 3:
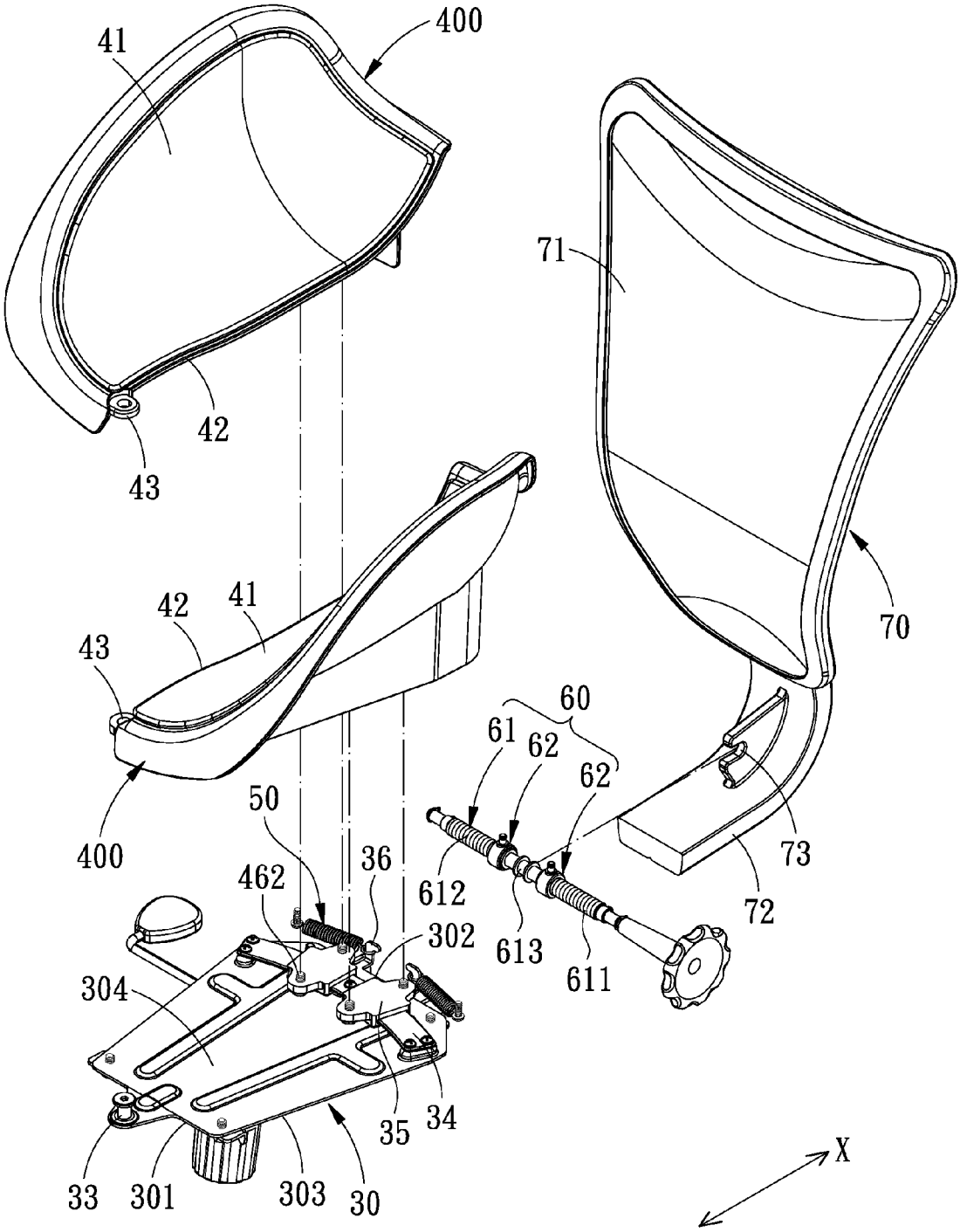
FIG. 3 is an exploded top view of the chair with a hip-shaping seat in accordance with the present invention.
Figure 4:
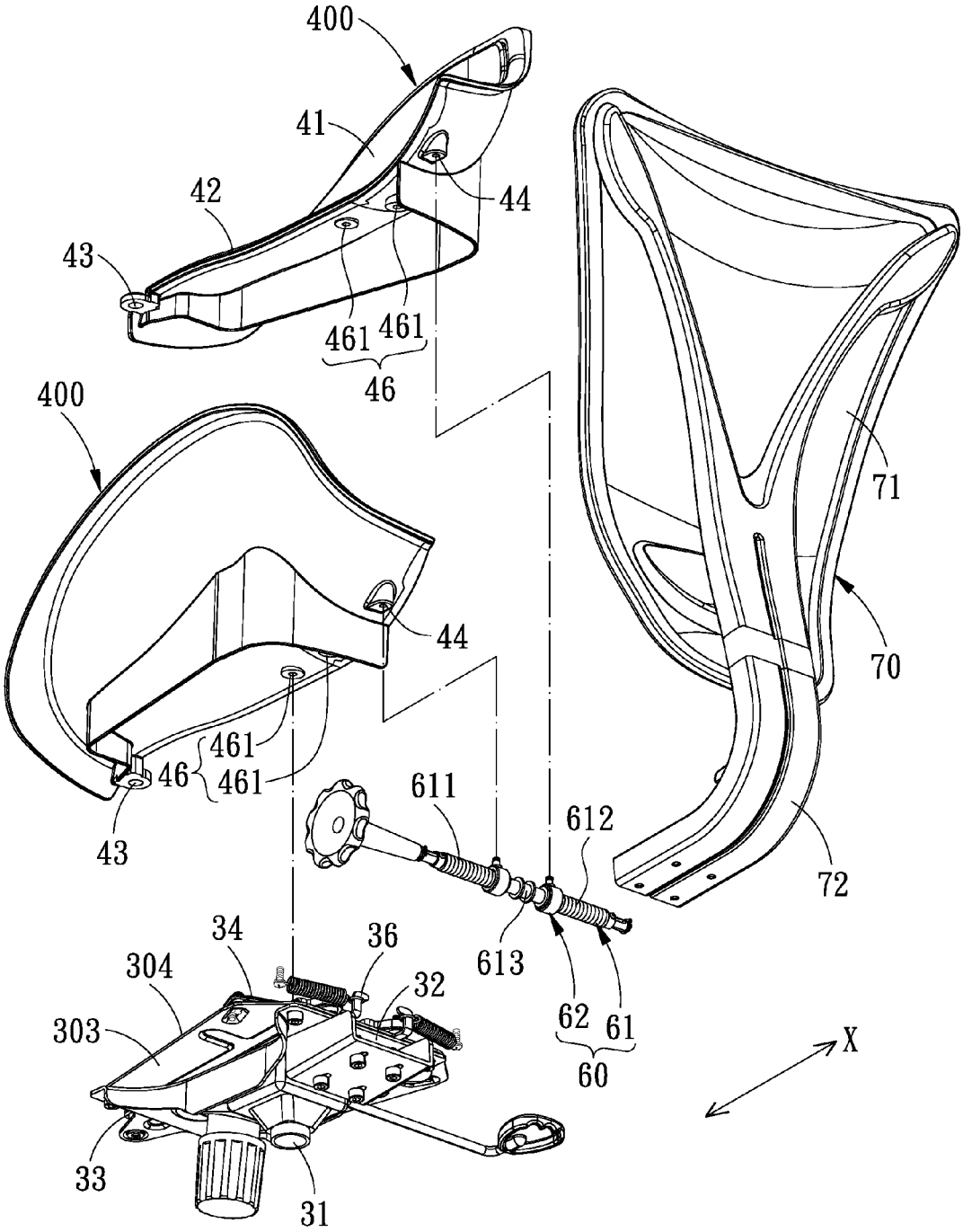
FIG. 4 is an exploded bottom view of the chair with a hip-shaping seat in accordance with the present invention.

The base 20 is provided with an assembling portion 21 in the form of a rod, and to the lower end of the assembling portion 21 is connected a roller-and-leg assembly 22. As shown in FIGS. 3 and 4, the chassis 30 includes a front end 301 and a rear end 302, and a direction extending from the front end 301 to the rear end 302 is defined as X. Between the front end 301 and the rear end 302 are connected a bottom surface 303 and a top surface 304. The bottom surface 303 is formed with an assembling portion 31 assembled to the assembling portion 21 of the base 20, and an inserting portion 32 formed at the rear end 302 of the chassis 30. On the top surface 304 of the chassis 30 are provided a pivot 33 located at the front end 301 and an arc-shaped guiding rail 34 located adjacent to the rear end 302, and the pivot 33 is the center of the arc-shaped guiding rail 34 (namely, the arc-shaped guiding rail 34 is a section of a circle whose center is located at the position of the pivot 33). On the arc-shaped guiding rail 34 are provided two slide blocks 35.

The seat 40 is formed by two symmetrical seat members 400. On the top of each of the seat members 400 is formed an arc-shaped surface 41 which has a flat and straight lateral edge 42, so that, when the two seat members 400 are assembled together along the lateral edges 42, the two arc-shaped surfaces 41 will cooperate with each other to define a seat space 401 curved to fit the hip A of the user. Each of the seat members 400 is provided with an ear portion 43 adjacent to one end of the lateral edge 42 for insertion of the pivot 33 of the chassis 30, and a pivot portion 44 adjacent to another end of the lateral edge 42 for insertion of the adjustment rod 60. Each of the seat members 400 is further formed on a bottom thereof with an assembling portion 46 which is located adjacent to the lateral edge 42 for assembling the slide blocks 35 of the chassis 30.

Figure 5:
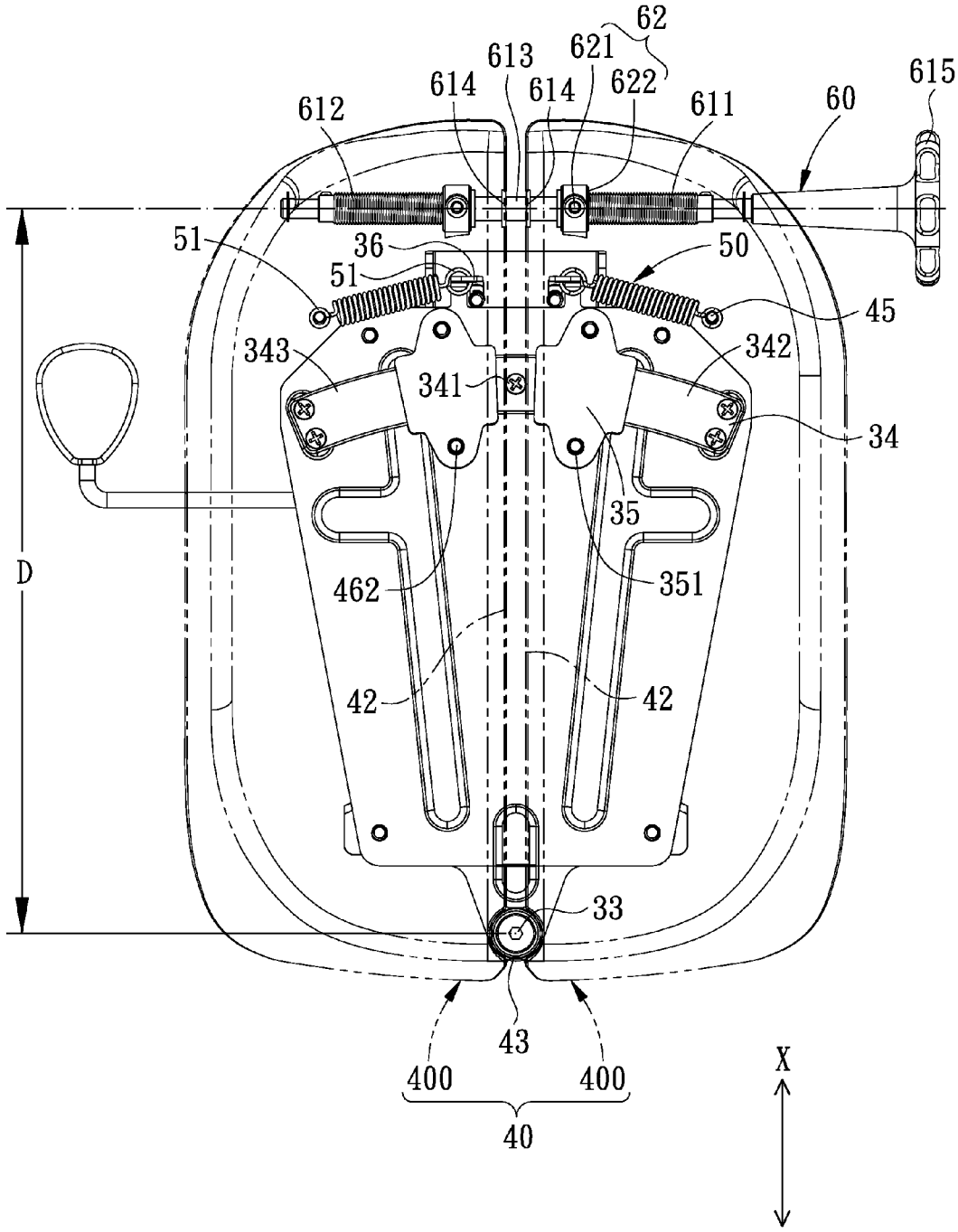
FIG. 5 is a top view of the chair with a hip-shaping seat in accordance with the present invention, wherein the two seat members are closed.

In this embodiment, as shown in FIGS. 3-5, each of the two slide blocks 35 of the chassis 30 is formed with two through holes 351, and each of the assembling portions 46 of the seat members 400 is formed with two locking holes 461, so that a corresponding number of fasteners 462 are inserted through the through holes 351 of the slide blocks 35 and the locking holes 461 of the seat members 400 to fix the slide blocks 35 to the seat members 400.

Figure 9:
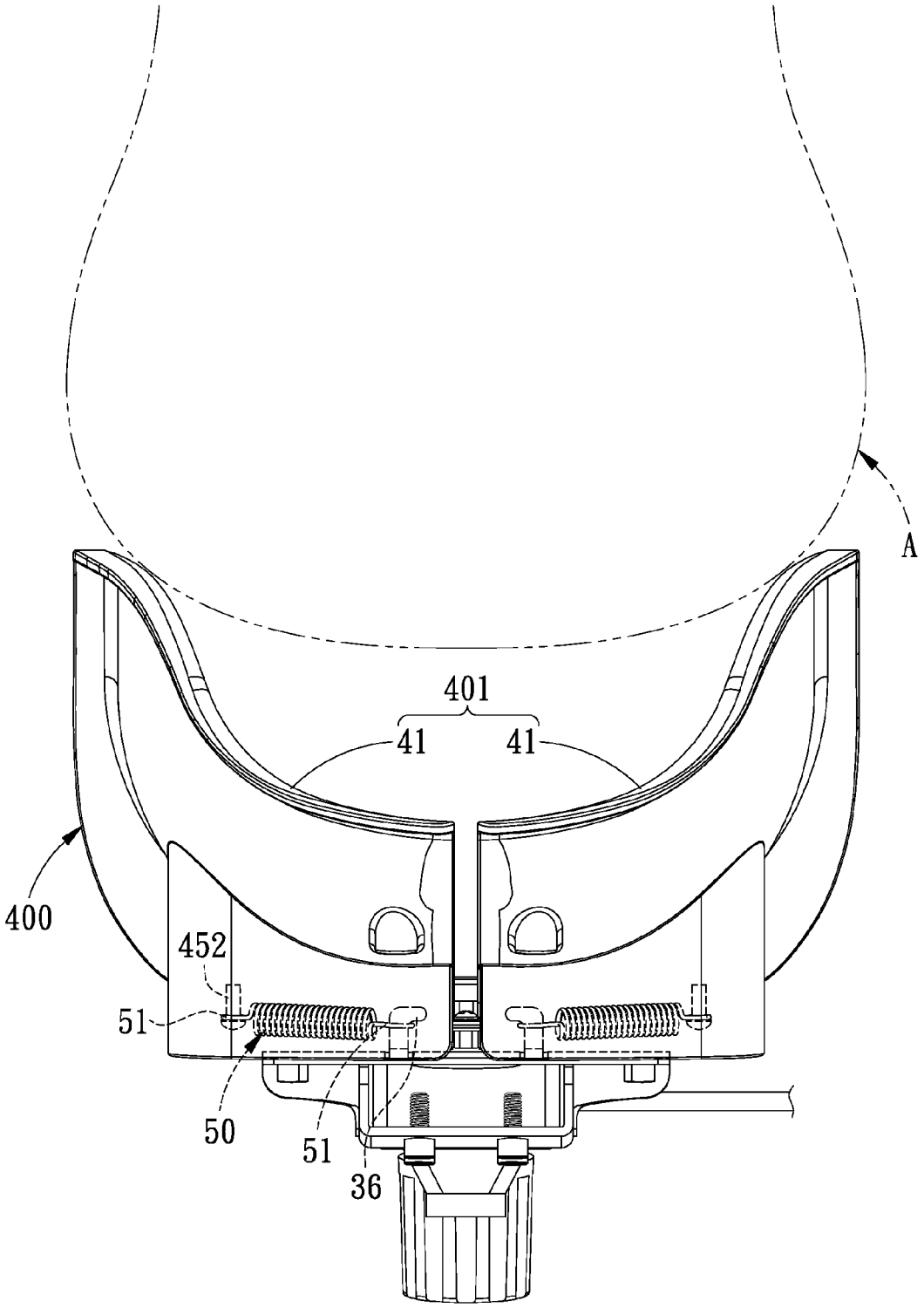
FIG. 9 is an illustrative view of the chair with a hip-shaping seat in accordance with the present invention, wherein the hip A of a user has not sat on the seat.

The elastic members 50 are disposed between the chassis 30 and the seat members 400, as shown in FIGS. 5 and 9, in such a manner that each of the elastic members 50 is provided with two hooks 51 formed at both ends thereof and has one end fixed to the chassis 30 and another end fixed to the bottom of the seat members 400. The chassis 30 is formed at the middle of the rear end 302 with two hook portions 36. Each of the seat members 400 is formed at the bottom thereof with a fixing portion 45 which is formed with an assembling hole 451, and a fastener 452 is inserted in the assembling hole 451, so that the two hooks 51 of the elastic members 50 are fixed to the hook portions 36 of the chassis 30 and the fixing portions 45 of the seat members 400, respectively.

As shown in FIGS. 3-5, the adjustment rod 60 comprises a rod portion 61 and two positioning rings 62. The rod portion 61 is formed on the outer surface thereof with a clockwise thread 611, a counterclockwise thread 612, and a positioning section 613 between the clockwise thread 611 and the counterclockwise thread 612. Each of the positioning rings 62 is formed with a pivot 621 to be pivotally connected to the pivot portion 44 of the seat members 400 and a threaded hole 622 for insertion of the rod portion 61, in such a manner that the threaded hole 622 of one of the positioning rings 62 is screwed with the clockwise thread 611, and the threaded hole 622 of another one of the positioning rings 62 is screwed with the counterclockwise thread 612. At the end of the rod portion 61 is provided a rotary knob 615 for rotating the adjustment rod 60.

Figure 7:
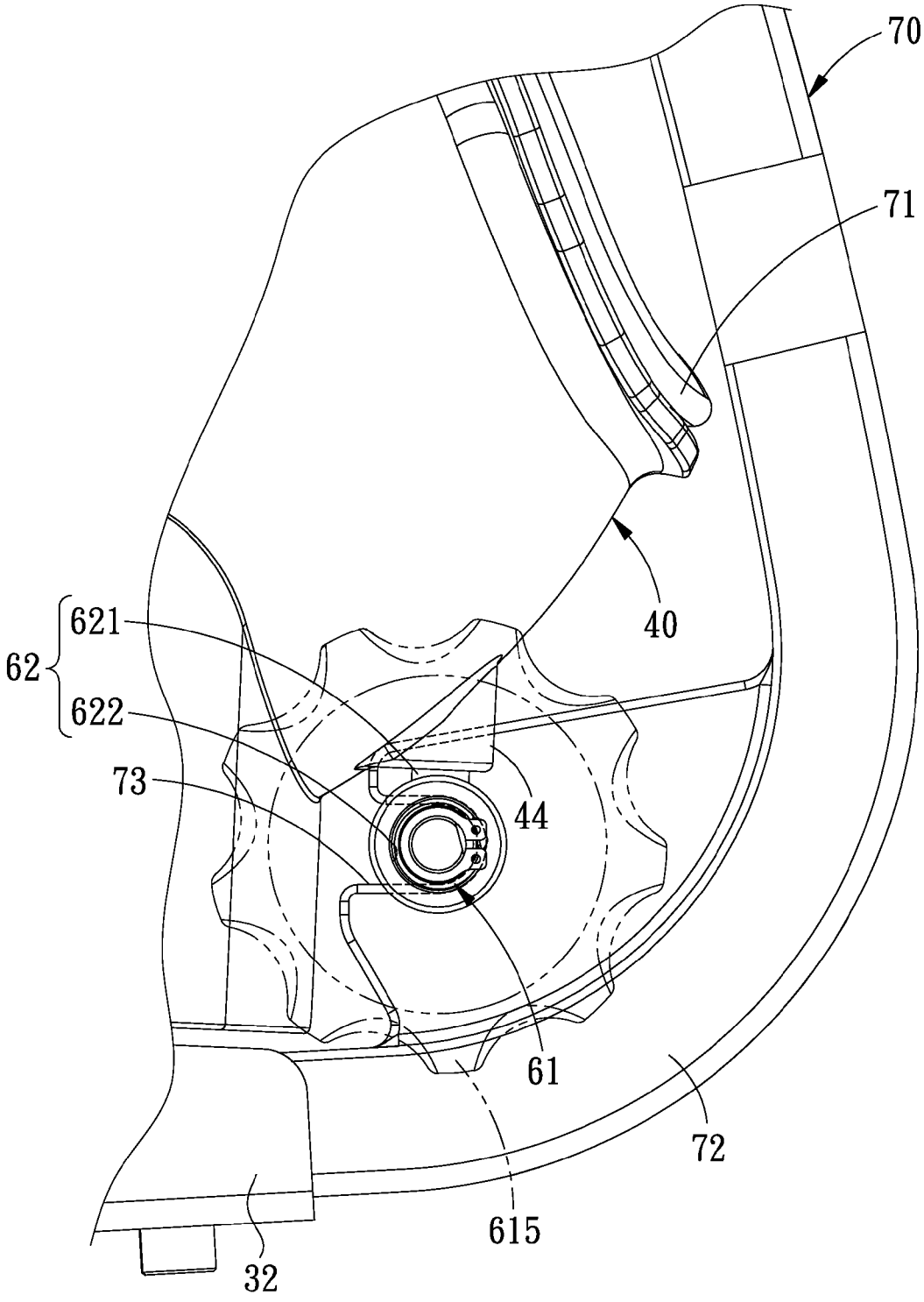
FIG. 7 is a side view of the chair with a hip-shaping seat in accordance with the present invention, wherein the two seat members are closed.

As shown in FIGS. 3, 4 and 7, the chair back 70 includes a back portion 71 and an L-shaped fixing portion 72 extending from the bottom of the back portion 71. In the middle of the fixing portion 72 is formed a positioning slot 73 extending in the direction X. The fixing portion 72 is inserted in the inserting portion 32 of the chassis 30, and the positioning section 613 of the rod portion 61 of the adjustment rod 60 is restricted in the positioning slot 73.

What mentioned above are the structural relations of the main components of the present invention, for a better understanding of its operation and function, reference should be made to FIGS. 5-10.

Figure 6:
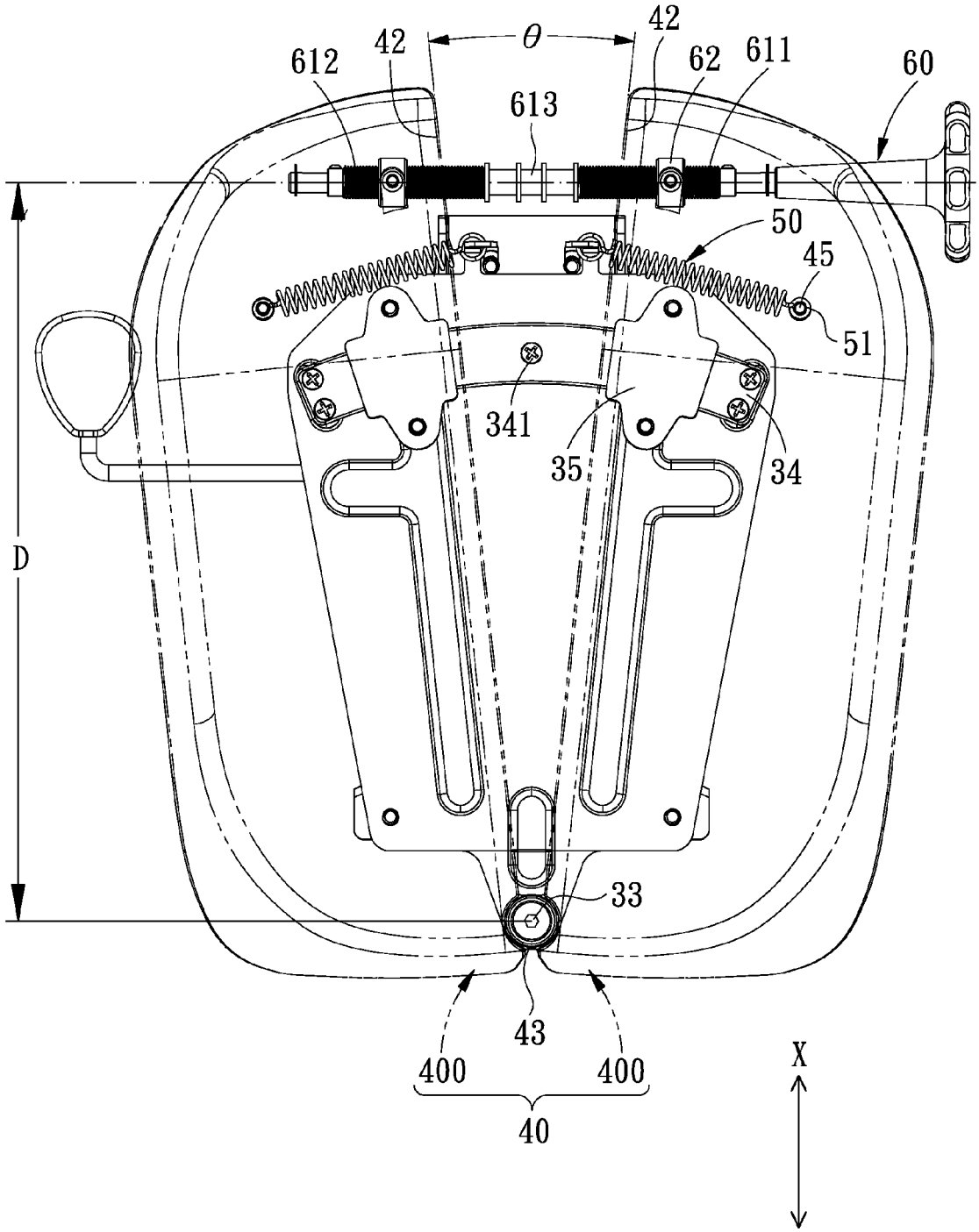
FIG. 6 is top view of the chair with a hip-shaping seat in accordance with the present invention, wherein the two seat members are opened.

As shown in FIGS. 5 and 6, the chair with a hip-shaping seat in accordance with the present invention is such that the positioning rings 62 of the adjustment rod 60 are pivotally fixed to the two seat members 400 and screwed with the clockwise and counterclockwise threads 611, 612, respectively. When the adjustment rod 60 is rotated, the two positioning rings 62 are caused to rotate along the clockwise and counterclockwise threads 611, 612, to move simultaneously toward the middle or both ends of the adjustment rod 60, making the two seat members 400 pivot about the pivot 33 of the chassis 30, as a result, the lateral edges 42 of the two seat members 400 are pulled together to press against each other or move away from each other to form an angle θ therebetween.

The arc-shaped guiding rail 34 of the chassis 30 has a middle point 341, a section from the middle point 341 to one end of the arc-shaped guiding rail 34 is defined as left section 342, and a section from the middle point 341 to another end of the arc-shaped guiding rail 34 is defined as a right section 343. The two slide blocks 35 are mounted on the left and right sections 342, 343. When the two seat members 400 are pivoted by rotating the adjustment rod 60, the slide blocks 35 will slide along the left and right sections 342, 343, respectively.

Figure 8:
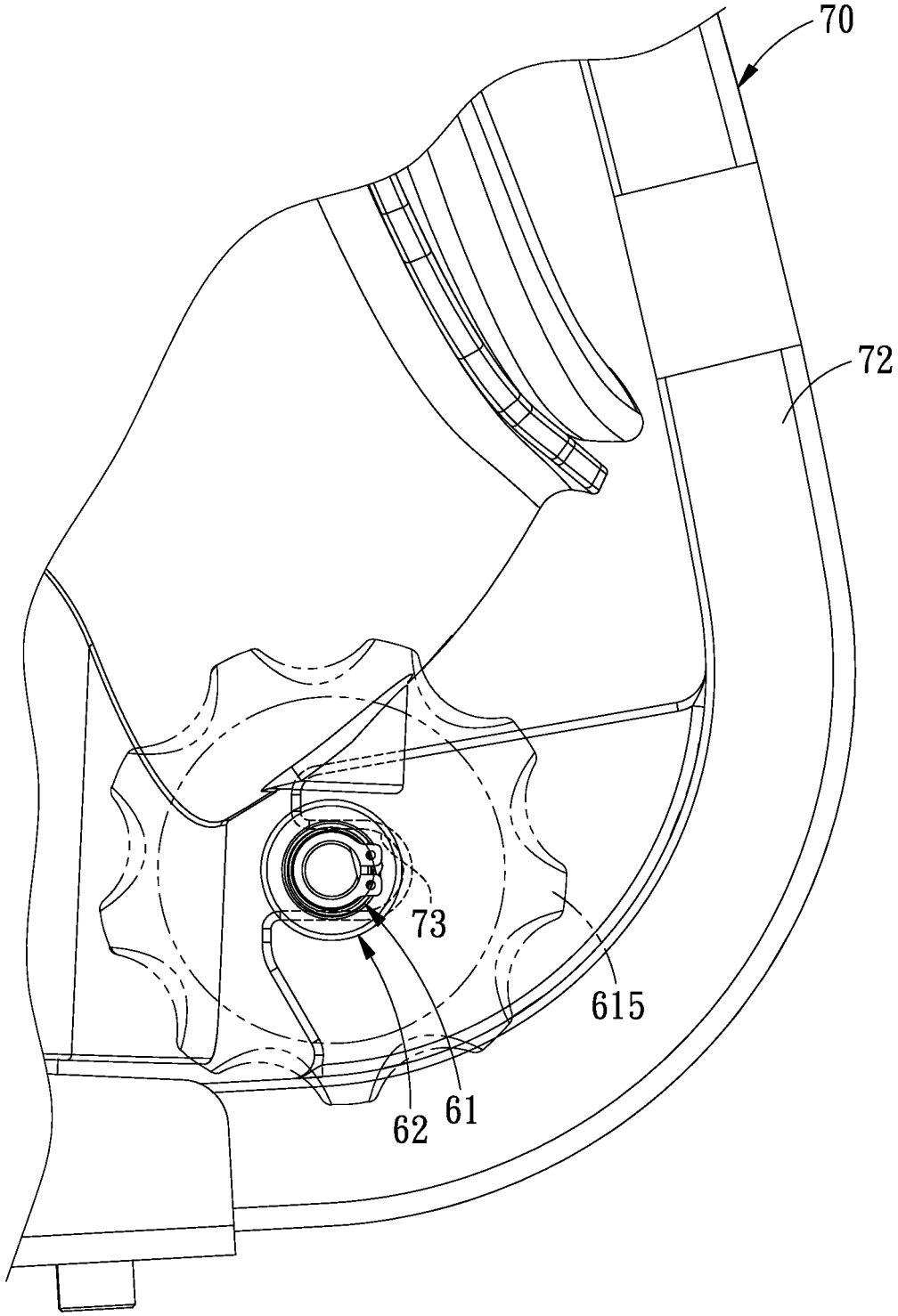
FIG. 8 is side view of the chair with a hip-shaping seat in accordance with the present invention, wherein the two seat members are opened.

At the junctures between the positioning section 613 of the rod portion 61 and the clockwise thread 611 and counterclockwise thread 612 is formed an annular rib 614, respectively, for restricting the positioning slot 73 of the chair back 70 on the positioning section 613. As shown in FIGS. 7 and 8, when the two seat members 400 are pivoted away from each other, the adjustment rod 60 will move in the direction X away from the bottom of the positioning slot 73 of the chair back 70. As a result, as shown in FIGS. 5 and 6, the distance D in the direction X from the adjustment rod 60 to the pivot 33 of the chassis 30 will be reduced, so that the two seat members 400 can be pivoted away from each other.

Figure 10:
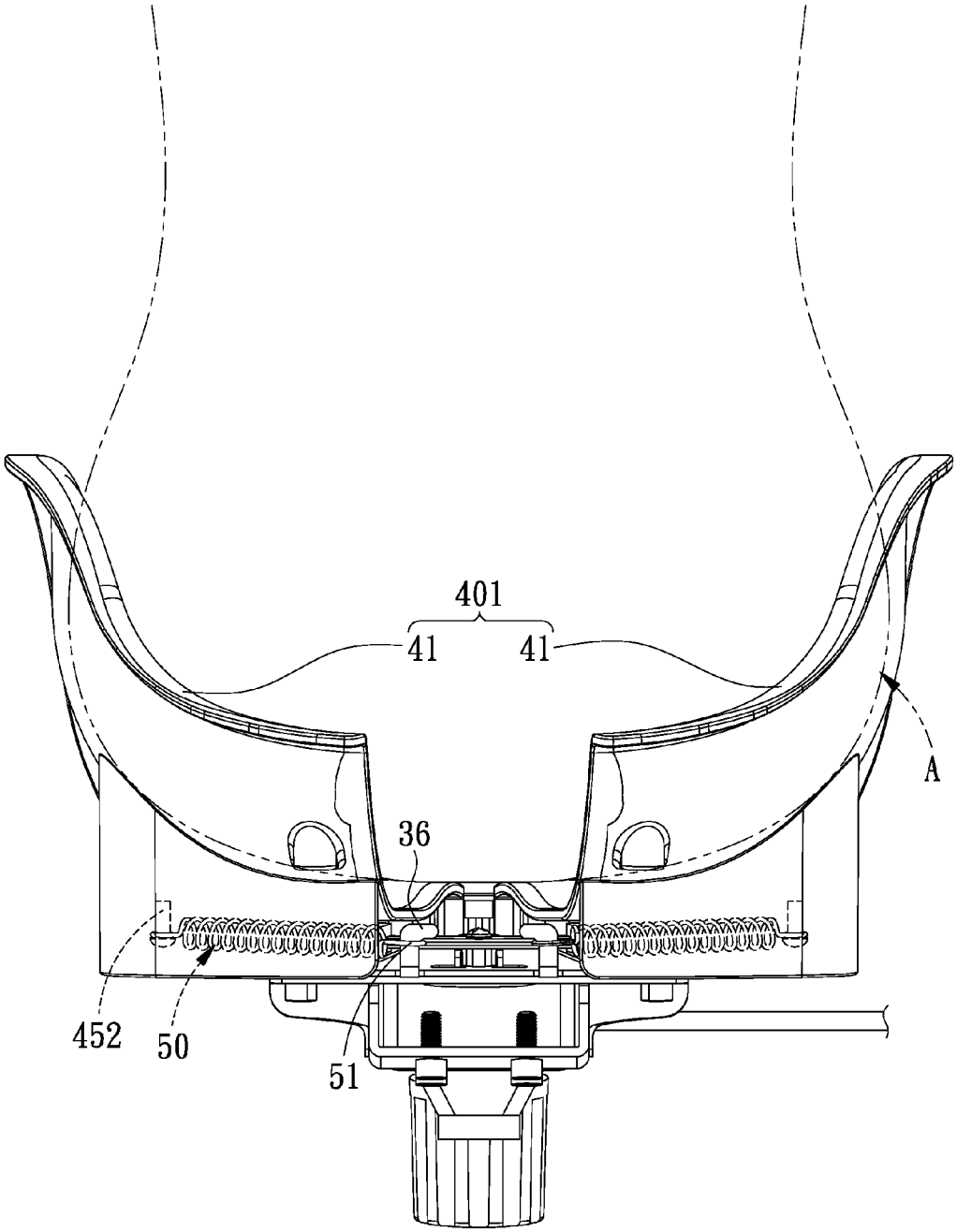
FIG. 10 is an illustrative view of the chair with a hip-shaping seat in accordance with the present invention, wherein the hip A of the user has sat on the seat.

It is to be noted that, as shown in FIGS. 9 and 10, in order to hold the hip A and prevent the hip A from sagging, the seat space 401 formed by the arc-shaped surfaces 41 of the two seat members 400 is ergonomic and designed to fit the shape of the hip. Furthermore, the two elastic members 50 between the seat 40 and the chassis 30 provide a certain pivoting flexibility for the two seat members 400, so that, when the two seat members 400 pivot to form the seat space 401 which has a width slightly smaller than the width of the user's hip A, the pivoting flexibility allows the seat space 401 to expand a little when the user's hip A sits on the chair. Moreover, the elastic members 50 can expand to provide a certain flexibility to enable the seat members 400 to better hold the hip A.

In general, the chair with a hip-shaping seat in accordance with the present invention is capable of effectively holding the hip A and preventing the hip A from sagging. Furthermore, the width of the seat space 401 can also be adjusted to fit different sized hips A, through pivoting of the seat members 400.

While we have shown and described various embodiments in accordance with the present invention, it is clear to those skilled in the art that further embodiments may be made without departing from the scope of the present invention.

What is claimed is:

1. A chair with a hip-shaping seat comprising:

a base with an assembling portion;

a chassis with a front end and a rear end, and a direction extending from the front end to the rear end being defined as X, between the front end and the rear end being connected a bottom surface and a top surface, the bottom surface being formed with an assembling portion assembled to the assembling portion of the base, and an inserting portion formed at the rear end of the chassis, on the top surface of the chassis being provided a pivot located at the front end and an arc-shaped rail located adjacent to the rear end, and the pivot being a section of a circle whose center is located at the position of the pivot, on the guiding rail being provided two slide blocks;

a seat formed by two symmetrical seat members, on top of each of the seat members being formed an arc-shaped surface which has a lateral edge, so that, when the two seat members are assembled together along the lateral edges, the two arc-shaped surfaces cooperate with each other to define a seat space, each of the seat members being provided with an ear portion adjacent to one end of the lateral edge for insertion of the pivot of the chassis, and a pivot portion adjacent to another end of the lateral edge, each of the seat members being further formed on a bottom thereof with an assembling portion which is located adjacent to the lateral edge for assembling the slide blocks of the chassis;

an adjustment rod including a rod portion and two positioning rings, the rod portion being formed with a clockwise thread, a counterclockwise thread, and a positioning section between the clockwise thread and the counterclockwise thread, each of the positioning rings being formed with a pivot to be pivotally connected to the pivot portion of the seat members and a threaded hole for insertion of the rod portion, in such a manner that the threaded hole of one of the positioning rings is screwed with the clockwise thread, and the threaded hole of another one of the positioning rings is screwed with the counterclockwise thread; and a chair back with a back portion and a fixing portion extending from a bottom of the back portion, in the middle of the fixing portion being formed a positioning slot extending in the direction X, the fixing portion being inserted in the inserting portion of the chassis, and the positioning section of the rod portion of the adjustment rod being restricted in the positioning slot.

2. The chair with a hip-shaping seat as claimed in claim 1, wherein the guiding rail of the chassis has a middle point, a section from the middle point to one end of the guiding rail is defined as left section, and a section from the middle point to another end of the guiding rail is defined as a right section, the two slide blocks are mounted on the left and right sections, when the two seat members are pivoted by rotating the adjustment rod, the slide blocks will slide along the left and right sections, respectively.

3. The chair with a hip-shaping seat as claimed in claim 1, wherein each of the two slide blocks of the chassis is formed with two through holes, and each of the assembling portions of the seat members is formed with two locking holes, so that a corresponding number of fasteners are inserted through the through holes of the slide blocks and the locking holes of the seat members to fix the slide blocks to the seat members.

4. The chair with a hip-shaping seat as claimed in claim 1, wherein the chassis is formed at the middle of the rear end with two hook portions, each of the seat members is formed at a bottom thereof with a fixing portion, two elastic members are disposed between the chassis and the seat members, in such a manner that each of the elastic members is provided with two hooks formed at both ends thereof, and the two hooks of the elastic members are fixed to the hook portions of the chassis and the fixing portions of the seat members, respectively.

5. The chair with a hip-shaping seat as claimed in claim 4, wherein each of the fixing portions of the seat members is formed with an assembling hole for insertion of a fastener, and then the elastic members are hooked to the fastener.

6. The chair with a hip-shaping seat as claimed in claim 1, wherein at junctures between the positioning section of the rod portion and the clockwise thread and counterclockwise thread is formed an annular rib, respectively, for restricting the positioning slot of the chair back on the positioning section, and at one end of the rod portion is provided a rotary knob for rotating the adjustment rod.

7. The chair with a hip-shaping seat as claimed in claim 1, wherein the assembling portion of the base is in the form of a rod, and to a lower end of the assembling portion of the base is connected a roller-and-leg assembly.

* * * * *